US011378249B2

(12) United States Patent
Kim et al.

(10) Patent No.: US 11,378,249 B2
(45) Date of Patent: Jul. 5, 2022

(54) HEAD LAMP FOR VEHICLE

(71) Applicant: HYUNDAI MOBIS CO., LTD., Seoul (KR)

(72) Inventors: Do Hyung Kim, Yongin-si (KR); Tae Kyoung Jin, Yongin-si (KR); Moo Kwan Kim, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/386,926

(22) Filed: Jul. 28, 2021

(65) Prior Publication Data

US 2022/0034474 A1 Feb. 3, 2022

(30) Foreign Application Priority Data

Jul. 29, 2020 (KR) ..... 10-2020-0094298

(51) Int. Cl.
*F21S 45/20* (2018.01)

(52) U.S. Cl.
CPC ..... *F21S 45/20* (2018.01)

(58) Field of Classification Search
CPC ..... F21S 45/20
See application file for complete search history.

(56) References Cited

U.S. PATENT DOCUMENTS 6,278,431 B1 * 8/2001 Kao ..... G09F 9/375 345/111

FOREIGN PATENT DOCUMENTS

| | | | |
|---|---|---|---|
| DE | 20 2004 019 133 | U1 | 6/2005 |
| DE | 10 2012 004 759 | A1 | 9/2013 |
| DE | 10 2016 013 510 | A1 | 10/2017 |
| EP | 3 597 991 | A1 | 1/2020 |
| KR | 10-1487904 | B1 | 2/2015 |
| WO | WO 2016/089926 | A1 | 6/2016 |

OTHER PUBLICATIONS

Extended European Search Report dated Dec. 2, 2021 in counterpart European Patent Application No. 21188160.2. (6 pages in English).

* cited by examiner

*Primary Examiner* — Thomas M Sember
(74) *Attorney, Agent, or Firm* — NSIP Law

(57) ABSTRACT

A head lamp for a vehicle includes: a lamp housing; a light source disposed in the lamp housing and configured to emit light to a forward area of a vehicle; a bezel disposed on the lamp housing, spaced apart from the light source, and shaped to cover the light source; and a plurality of flip-dot units disposed in the bezel. Each flip-dot unit among the plurality of flip-dot units includes: a housing having an opening formed on one side the housing, and a space formed in the housing; and a flip disk rotatably installed in the housing and configured to selectively open and close the opening.

11 Claims, 10 Drawing Sheets

HEAD LAMP FOR VEHICLE

CROSS-REFERENCE TO RELATED APPLICATION

This application claims the benefit under 35 U.S.C. § 119(a) of Korean Patent Application No. 10-2020-0094298 filed on Jul. 29, 2020 in the Korean Intellectual Property Office, the entire disclosure of which is incorporated herein by reference for all purposes.

BACKGROUND

Field

Exemplary embodiments of the present disclosure relate to a head lamp for a vehicle, and more particularly, to a head lamp for a vehicle, which includes a flip-dot unit installed in a lamp housing in order to prevent overheat and moisture in the lamp housing and to effectively inform an oncoming vehicle or pedestrian of notice information on the state of a vehicle or notice information related to the driving of the vehicle.

Discussion of the Background

In general, when a vehicle travels on the road through a tunnel or in the nighttime, a head lamp of the vehicle emits light to the forward area of the vehicle such that a driver can easily check and identify an object ahead of vehicle. The head lamp is typically installed on either side of the front of the vehicle.

The head lamp of the vehicle uses two light sources to adjust the brightness of light, when illuminating the forward area of the vehicle. Any one of the light sources is used as a low beam capable of illuminating an area at a relatively small distance, and the other of the light sources is used as a high beam capable of illustrating an area at a relatively large distance.

In such a head lamp for a vehicle, an incandescent lamp or halogen lamp is typically used as the light source for emitting light. Recently, the case in which an LED having low power consumption and excellent light straightness is used as a light source is increasing.

According to the recent trend in which a head lamp for a vehicle is designed to have a small size, a lamp housing may lack in an air flow space. In this case, the humidity inside the lamp housing may be increased to cause condensation.

Furthermore, when the head lamp for a vehicle is exposed to sunlight for a long time, the surface of a bezel part of the lamp housing may be corrupted or deformed as the temperature of the bezel part increases.

With the recent development of autonomous driving technology, technologies related to full-scale driving of autonomous vehicles are being developed. Furthermore, research is being conducted on an apparatus and method capable of effectively transferring notice information on the state of an autonomous vehicle or notice information related to the driving of the autonomous vehicle to an oncoming vehicle or pedestrian, among the technologies related to autonomous vehicles. Besides, there is a need for developing an apparatus and method which can display notice information related to an autonomous vehicle to the outside of the vehicle more effectively with lower power consumption, and minimize damage to a pedestrian.

The related art of the present disclosure is disclosed in Korean Patent No. 10-1487904 registered on Jan. 23, 2015 and entitled "Flip Dot Display Element using Electromagnet and Assembly Module Thereof".

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a head lamp for a vehicle includes: a lamp housing; a light source disposed in the lamp housing and configured to emit light to a forward area of a vehicle; a bezel disposed on the lamp housing, spaced apart from the light source, and shaped to cover the light source; and a plurality of flip-dot units disposed in the bezel. Each flip-dot unit among the plurality of flip-dot units includes: a housing having an opening formed on one side the housing, and a space formed in the housing; and a flip disk rotatably installed in the housing and configured to selectively open and close the opening.

The housing may include: a first side portion having a plate shape, and having an air flow hole in communication with the opening; a second side portion bent and extended from the first side portion, and configured to form the space with the first side portion; and a third side portion bent and extended from the second side portion, disposed to face the first side portion, and having the flip disk installed thereon.

The flip disk may be configured to rotate about a rotation axis passing through a center of the third side portion.

The flip disk may have a symmetrical shape with respect to a center axis.

The head lamp may further include: a sensor unit disposed in the bezel and configured to measure an internal temperature and internal humidity of the lamp housing; and a control unit configured to transmit a flip disk operation signal to the flip-dot unit to rotate the flip disk.

The control unit may be further configured to transmit the flip disk operation signal to the flip-dot unit to rotate and invert the flip disk according to the internal temperature of the lamp housing, as measured by the sensor unit.

The control unit may be further configured to transmit the flip disk operation signal to the flip-dot unit to repeatedly rotate the flip disk according to the internal humidity of the lamp housing, as measured by the sensor unit.

The control unit may be further configured to transmit the flip disk operation signal to the flip-dot unit to display a character or sign for warning an oncoming vehicle or pedestrian.

The head lamp may further include a control unit configured to control the flip disk to rotate such that a heated surface of the flip disk faces the bezel, in response to an internal temperature of the lamp being determined to be equal to or greater than a preset value.

The head lamp may further include a control unit configured to control the flip disk to repeatedly rotate such that moisture is removed from the lamp housing, in response to an internal humidity of the lamp housing being determined to be equal to or greater than a preset value.

Other features and aspects will be apparent from the following detailed description, the drawings, and the claims.

DETAILED DESCRIPTION OF THE ILLUSTRATED EMBODIMENTS

Hereinafter, a head lamp for a vehicle will be described below with reference to the accompanying drawings through various exemplary embodiments. It should be noted that the drawings are not to precise scale and may be exaggerated in thickness of lines or sizes of components for descriptive convenience and clarity only. Furthermore, the terms as used herein are defined by taking functions of the invention into account and can be changed according to the custom or intention of users or operators. Therefore, definition of the terms should be made according to the overall disclosures set forth herein.

Figure 1:
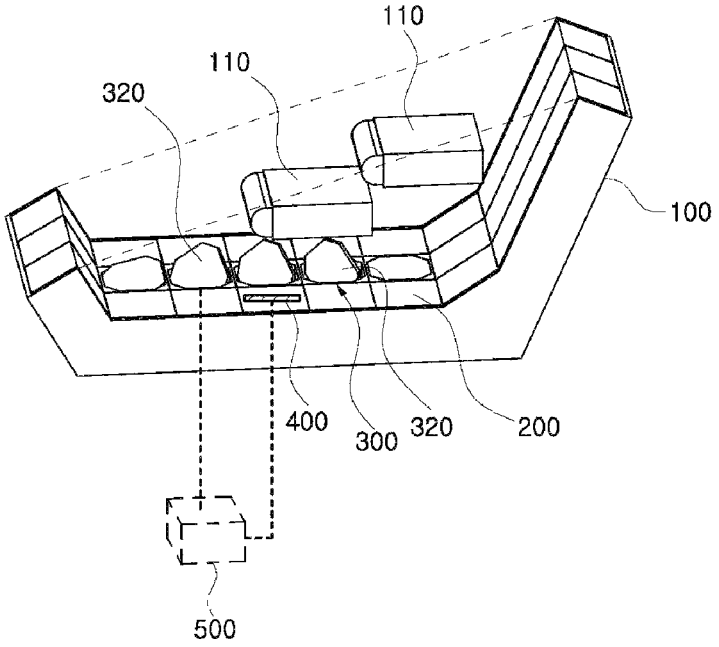
FIG. 1 is a diagram schematically illustrating a head lamp for a vehicle in accordance with an embodiment of the present disclosure.
Figure 2:
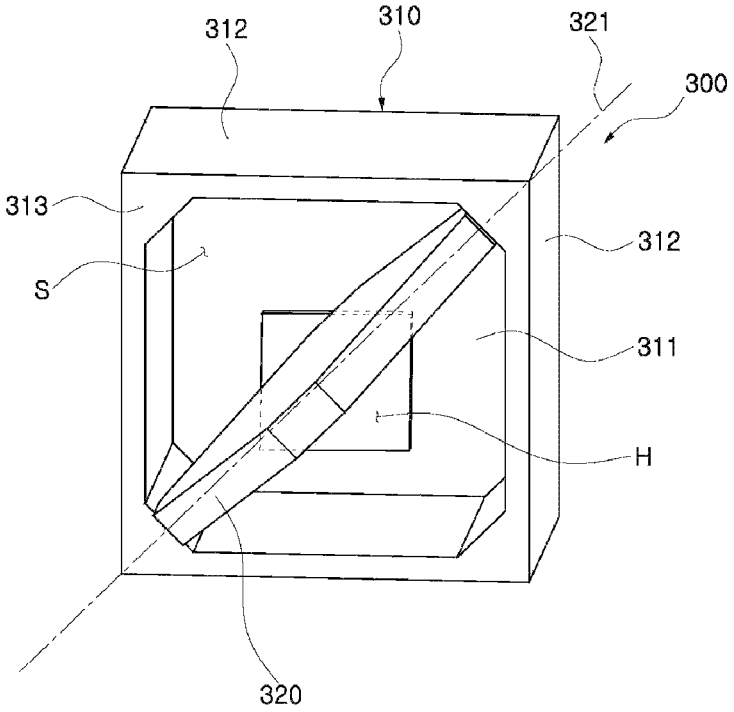
FIG. 2 is a diagram schematically illustrating a flip-dot unit applied to the head lamp for a vehicle in accordance with the embodiment of the present disclosure.
Figure 3:
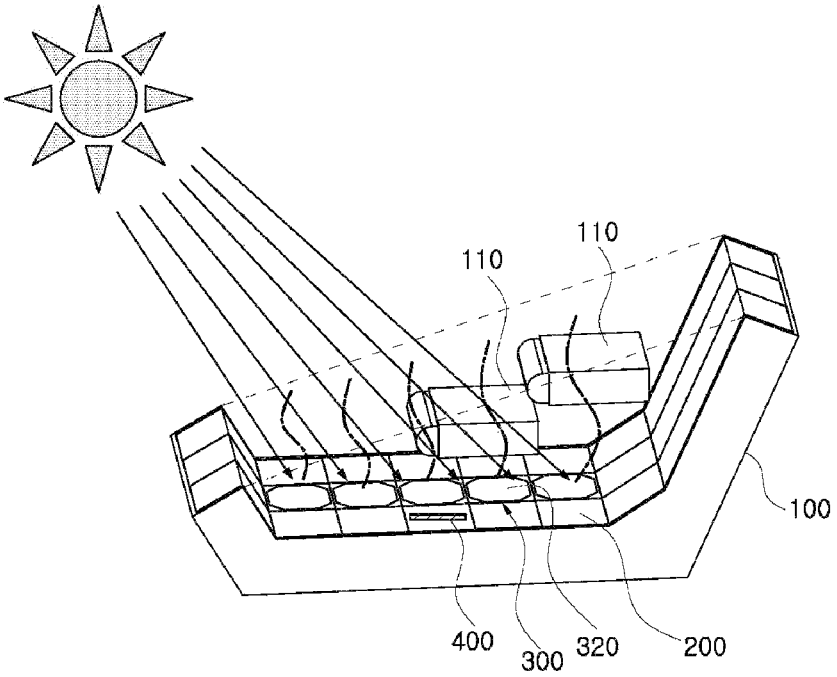
FIG. 3 is a diagram illustrating an example of the case in which the temperature of a lamp housing applied to the head lamp for a vehicle in accordance with the embodiment of the present disclosure rises.
Figure 4:
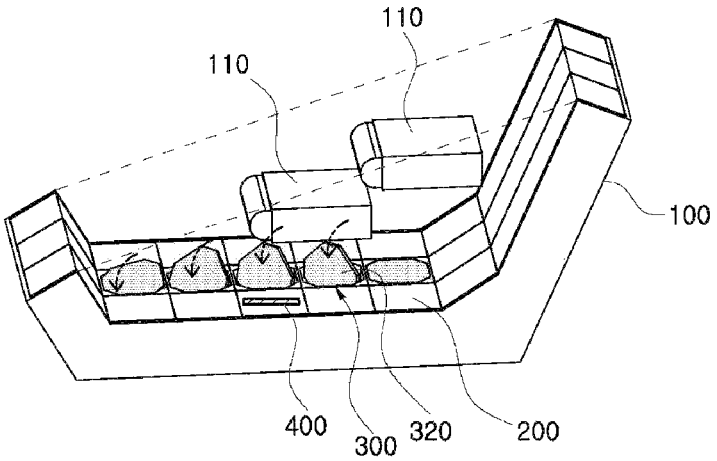
FIG. 4 is a diagram illustrating an operation state of the flip-dot unit to lower the temperature of the lamp housing applied to the head lamp for a vehicle in accordance with the embodiment of the present disclosure.
Figure 5:
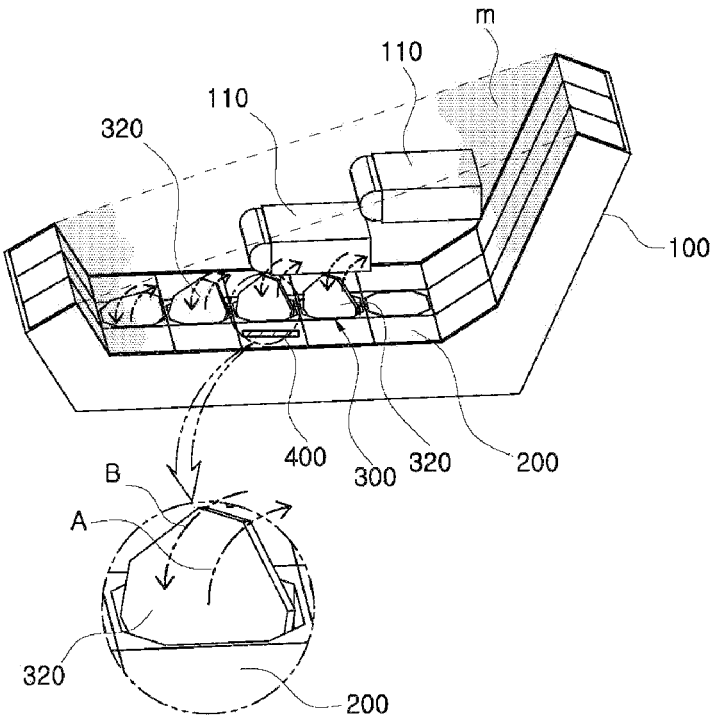
FIG. 5 is a diagram illustrating an operation state of the flip-dot unit to lower the humidity of the lamp housing applied to the head lamp for a vehicle in accordance with the embodiment of the present disclosure.
Figure 6:
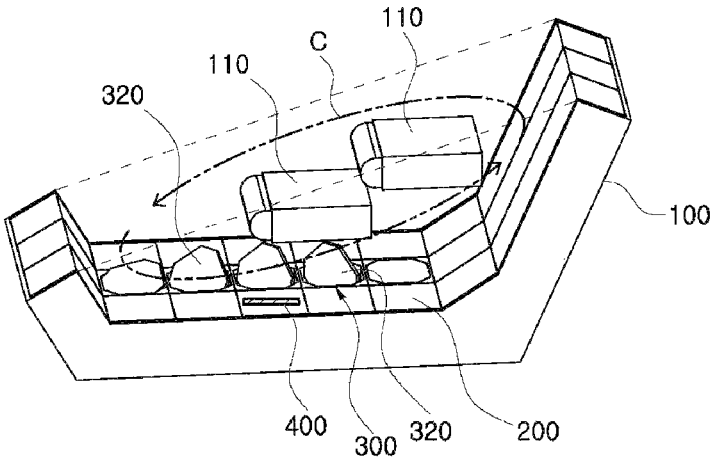
FIG. 6 is a diagram illustrating the state in which the air of the lamp housing is circulated to remove humidity through an operation of the flip-dot unit applied to the head lamp for a vehicle in accordance with the embodiment of the present disclosure.
Figure 7:
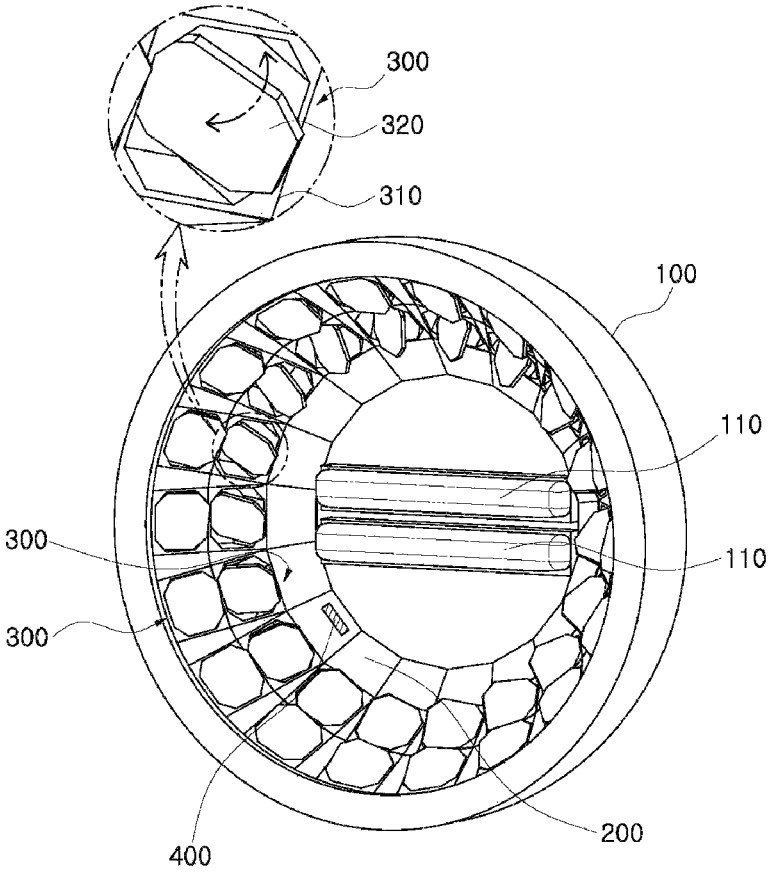
FIG. 7 is a diagram schematically illustrating the head lamp for a vehicle in accordance with the embodiment of the present disclosure, showing an example of the case in which the lamp housing is formed in a hemispherical shape.
Figure 8:
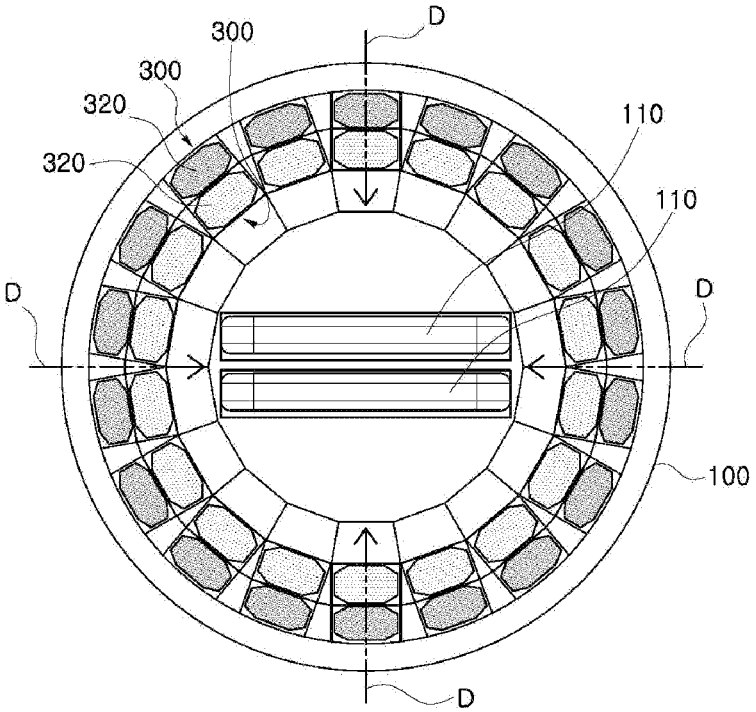
FIG. 8 is a diagram illustrating an example of the case in which notice information on the state of the vehicle is displayed through the operation of the flip-dot unit applied to the head lamp for a vehicle in accordance with the embodiment of the present disclosure.
Figure 9:
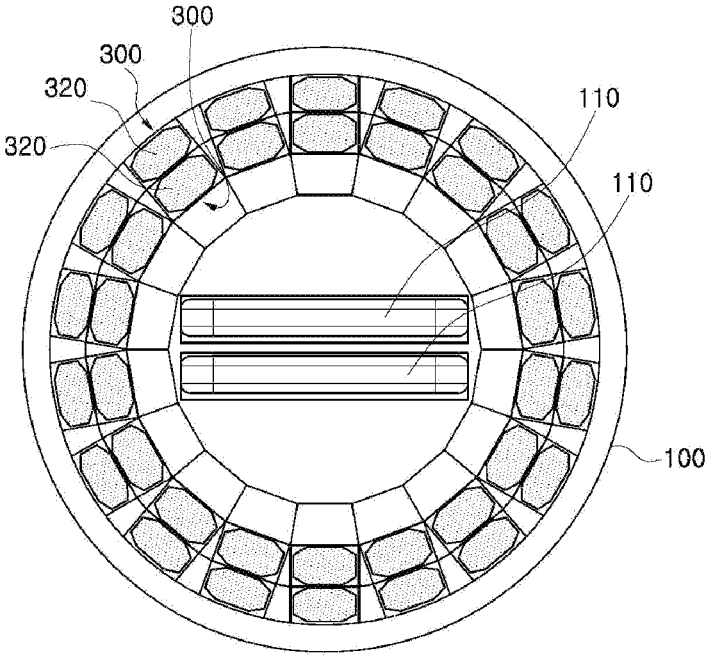
FIG. 9 is a diagram illustrating an example of the case in which notice information on the driving of a vehicle is displayed through the operation of the flip-dot unit applied to the head lamp for a vehicle in accordance with the embodiment of the present disclosure.
Figure 10:
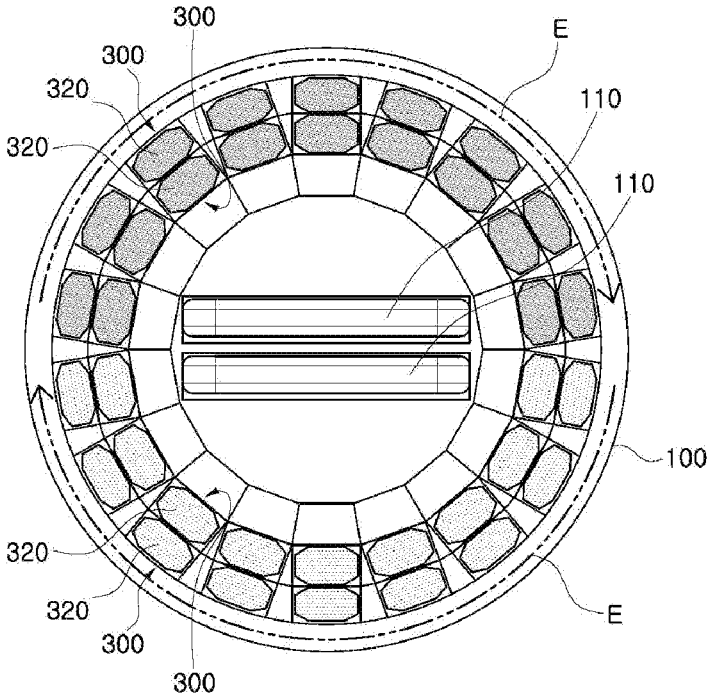
FIG. 10 is a diagram illustrating another example of the case in which notice information on the driving of the vehicle is displayed through the operation of the flip-dot unit applied to the head lamp for a vehicle in accordance with the embodiment of the present disclosure.

FIG. 1 is a diagram schematically illustrating a head lamp for a vehicle in accordance with an embodiment of the present disclosure, FIG. 2 is a diagram schematically illustrating a flip-dot unit applied to the head lamp for a vehicle in accordance with the embodiment of the present disclosure, FIG. 3 is a diagram illustrating an example of the case in which the temperature of a lamp housing applied to the head lamp for a vehicle in accordance with the embodiment of the present disclosure rises, FIG. 4 is a diagram illustrating an operation state of the flip-dot unit to lower the temperature of the lamp housing applied to the head lamp for a vehicle in accordance with the embodiment of the present disclosure, FIG. 5 is a diagram illustrating an operation state of the flip-dot unit to lower the humidity of the lamp housing applied to the head lamp for a vehicle in accordance with the embodiment of the present disclosure, FIG. 6 is a diagram illustrating the state in which the air of the lamp housing is circulated to remove humidity through an operation of the flip-dot unit applied to the head lamp for a vehicle in accordance with the embodiment of the present disclosure, FIG. 7 is a diagram schematically illustrating the head lamp for a vehicle in accordance with the embodiment of the present disclosure, showing an example of the case in which the lamp housing is formed in a hemispherical shape, FIG. 8 is a diagram illustrating an example of the case in which notice information on the state of the vehicle is displayed through the operation of the flip-dot unit applied to the head lamp for a vehicle in accordance with the embodiment of the present disclosure, FIG. 9 is a diagram illustrating an example of the case in which notice information on the driving of a vehicle is displayed through the operation of the flip-dot unit applied to the head lamp for a vehicle in accordance with the embodiment of the present disclosure, and FIG. 10 is a diagram illustrating another example of the case in which notice information on the driving of the vehicle is displayed through the operation of the flip-dot unit applied to the head lamp for a vehicle in accordance with the embodiment of the present disclosure.

Referring to FIGS. 1 to 10, the head lamp for a vehicle in accordance with the embodiment of the present disclosure includes a lamp housing 100, a bezel 200 and a plurality of flip-dot units 300. The lamp housing 100 has a light source 110 installed therein, the light source 110 serving to emit light to a forward area of the vehicle. The bezel 200 is installed on the lamp housing 100, spaced by a predetermined distance apart from the light source 110, and disposed in a shape to cover the light source 110. The plurality of flip-dot units 300 are installed in the bezel 200.

As illustrated in FIG. 2, the flip-dot unit 300 includes a housing 310 and a flip disk 320. The housing 310 has an opening S formed on one side thereof and a space formed therein, and the flip disk 320 is rotatably installed in the housing 310 so as to open or close the opening S.

The housing 310 of the flip-dot unit 300 is formed in an approximately rectangular parallelepiped shape as a whole, and has the opening S formed on one side thereof and the space formed therein. When the opening S is closed by the flip disk 320, the housing 310 has a rectangular parallelepiped shape.

The housing 310 of the flip-dot unit 300 includes a first side portion 311, a second side portion 312 and a third side portion 313. The first side portion 311 is formed in a plate shape with an air flow hole H which communicates with the opening S, the second side portion 312 is bent and extended from the first side portion 311 so as to form the space with the first side portion 311, and the third side portion 313 is bent and extended from the second side portion 312, disposed to face the first side portion 311, and having the flip disk 320 installed thereon.

Outside the housing 310, an air flow duct (not illustrated) may be installed to communicate with the air flow hole H formed in the first side portion 311. The air flow duct may have an opening/closing member (not illustrated) installed to open/close the air flow duct. The opening/closing member may be operated to close or open the air flow duct according to the operation of the flip disk 320 to close or open the opening S.

The plurality of flip-dot units 300 may be installed in the bezel 200 of the head lamp for a vehicle in accordance with the embodiment of the present disclosure. Furthermore, a sensor unit 400 for measuring the internal temperature and humidity of the lamp housing 100 may be installed in the bezel 200.

Furthermore, the head lamp for a vehicle in accordance with the embodiment of the present disclosure may further include a control unit 500 configured to transmit a flip disk operation signal to the flip-dot unit 300 to rotate the flip disk 320.

The flip-dot unit 300 may rotate the flip disk 320 installed therein, in order to prevent overheat and humidity in the lamp housing 100.

Furthermore, each of the flip-dot units 300 may serve as a pixel of a general display device, and visualize and display notice information on the state of the vehicle or notice information related to the driving of the vehicle as figures, characters or signs, thereby calling an oncoming vehicle or pedestrian's attention.

The notice information on the state of the vehicle is information displayed by visualizing information on whether the vehicle is turned on/off, whether the vehicle is being stopped or traveling, or whether the vehicle is in an autonomous driving mode, and the notice information related to the driving of the vehicle is information displayed by visualizing the acceleration, deceleration or turn of the vehicle.

The flip disk 320 is referred to as a flip dot, formed in a polygonal or circular plate shape, and rotatably installed in the third side portion 313 of the housing 310 to open or close the opening S formed in the third side portion 313 of the housing 310.

The flip disk 320 has one surface and the other surface which have different colors, and is rotated to invert the color of the flip disk 320 which appears through the bezel 200.

The flip disk 320 may be rotated by an electromagnetic actuator (not illustrated), and the opening degree of the opening S may be changed according to the rotation angle of the flip disk 320, such that the amount of air circulated through the opening S is changed.

The flip disk 320 is installed to rotate about a rotation axis 321 passing through the center of the third side portion, and has a symmetrical shape with respect to the rotation axis 321. Therefore, the flip disk 320 is configured in such a manner that portions disposed on both sides of the rotation axis 321 have the same shape and cross-sectional area.

When the internal temperature of the lamp housing 100, measured by the sensor unit 400, is equal to or higher than a preset value, the control unit 500 may transmit a flip disk operation signal to the flip-dot unit 300 to rotate and invert the flip disk 320. This process may lower the internal temperature of the lamp housing 100 overheated by direct sunlight or the like.

Furthermore, when the internal humidity of the lamp housing 100, measured by the sensor unit 400, is equal to or higher than a preset value, the control unit 500 may transmit the flip disk operation signal to the flip-dot unit 300 to repeatedly rotate the flip disk 320. This process may circulate the air inside the lamp housing 100, thereby removing the humidity of the lamp housing 100.

Furthermore, the control unit 500 may transmit the flip disk operation signal to the flip-dot unit 300 to display a character or sign which can warn an oncoming vehicle or pedestrian. Through this process, the notice information on the state of the vehicle or the notice information related to the driving of the vehicle may be effectively transferred to an oncoming vehicle or pedestrian, which makes it possible to improve a traffic flow and to prevent an accident.

Hereafter, the operation of the head lamp for a vehicle in accordance with the embodiment of the present disclosure will be described in detail.

Referring to FIGS. 3 to 4, an overheat prevention function of the head lamp for a vehicle in accordance with the embodiment of the present disclosure will be described as follows.

FIG. 3 is a diagram illustrating an example of the case in which the temperature of the lamp housing applied to the head lamp for a vehicle in accordance with the embodiment of the present disclosure rises, and FIG. 4 is a diagram illustrating an operation state of the flip-dot unit to lower the temperature of the lamp housing applied to the head lamp for a vehicle in accordance with the embodiment of the present disclosure.

As illustrated in FIG. 3, the internal temperature of the lamp housing 100 may be excessively raised by direct sunlight. In particular, the temperature of the bezel 200 inside the lamp housing 100, which is directly exposed to direct sunlight, may rapidly rise.

When the internal temperature of the lamp housing 100 excessively rises, the control unit 500 may control the operation of the flip-dot unit 300 according to the temperature information measured by the sensor unit 400 installed in the bezel 200.

That is, when the internal temperature of the lamp housing 100 is equal to or higher than the preset value, the control unit 500 may rotate the flip disks 320 in the state illustrated in FIG. 3, such that the heated surfaces of the flip disks 320 are turned to face the inside of the bezel 200, and the opposite surfaces of the flip disks 320, which are not heated, are turned to appear through the bezel 200, as illustrated in FIG. 4. Then, the internal temperature of the lamp housing 100 may be lowered.

Referring to FIGS. 5 to 6, a humidity prevention function of the head lamp for a vehicle in accordance with the embodiment of the present disclosure will be described as follows.

FIG. 5 is a diagram illustrating an operation state of the flip-dot unit to lower the humidity of the lamp housing applied to the head lamp for a vehicle in accordance with the embodiment of the present disclosure, and FIG. 6 is a diagram illustrating that the air of the lamp housing is circulated to remove humidity according to the operation of the flip-dot unit applied to the head lamp for a vehicle in accordance with the embodiment of the present disclosure.

As illustrated in FIG. 5, moisture m may be generated in the lamp housing 100 by a temperature difference between the outside and the inside of the lamp housing 100.

When the moisture m is generated in the lamp housing 100, the control unit 500 may control the operation of the flip-dot unit 300 according to the humidity measured by the sensor unit 400 installed in the bezel 200.

That is, when the internal humidity of the lamp housing 100 is equal to or higher than a preset value, the control unit 500 may operate the flip disk 320 to repeatedly rotate as illustrated in FIG. 5. Then, as illustrated in FIG. 6, the air inside the lamp housing 100 may be circulated (e.g. circulation indicated by an arrow C), thereby removing the moisture generated in the lamp housing 100.

Furthermore, while the air inside the lamp housing 100 is circulated, the air inside the lamp housing 100 and the air outside the lamp housing 100 may be exchanged. In this case, the air inside the lamp housing 100 and the air outside the lamp housing 100 may be exchanged through the opening S and the air flow hole H which are formed in the housing 310 of the flip-dot unit 300.

Referring to FIGS. 7 to 10, the function of displaying the notice information on the state of the vehicle and the notice information related to the driving of the vehicle through the head lamp for a vehicle in accordance with the embodiment of the present disclosure will be described as follows.

FIG. 7 is a diagram schematically illustrating the head lamp for a vehicle in accordance with the embodiment of the present disclosure, showing an example of the case in which the lamp housing is formed in a semispherical shape.

When the lamp housing 100 has a hemispherical shape illustrated in FIG. 7, the function of displaying the notice information on the state of the vehicle or the notice information related to the driving of the vehicle may be exhibited more effectively than when the lamp housing 100 has the shape illustrated in FIG. 1.

When the hemispherical lamp housing 100 is applied as illustrated in FIG. 7, the flip-dot units 300 may be arranged in a circular shape along the bezel 200. In this case, the flip-dot units 300 may be arranged in two or more lines in order to display various pieces of notice information.

Even when the hemispherical lamp housing 100 is applied, the flip disks 320 of the flip-dot units 300 may be rotated to prevent overheat and moisture in the lamp housing 100, as described above.

FIG. 8 is a diagram illustrating an example of how the notice information on the state of the vehicle may be displayed through the head lamp for a vehicle in accordance with the embodiment of the present disclosure.

For example, when the vehicle is turned on, the flip disks 320 of the flip-dot units 300 may be operated to generate a flow (i.e. a flow indicated by an arrow D) from the edge of the lamp housing 10 to the center of the lamp housing 100 where the light source 110 is located, as illustrated in FIG. 8. In this way, the flip-dot unit 300 may inform an oncoming vehicle or pedestrian that the vehicle is turned on.

FIG. 9 is a diagram illustrating an example of how the notice information related to the driving of the vehicle may be displayed through the head lamp for a vehicle in accordance with the embodiment of the present disclosure.

For example, when the vehicle enters the autonomous driving mode, the entire flip disks 320 of the flip-dot units 300 may be repeatedly operated so that the surfaces of the flip disks 320 having the same color appear, thereby informing an oncoming vehicle or pedestrian that the vehicle is in the autonomous driving mode, as illustrated in FIG. 9.

FIG. 10 is a diagram illustrating another example of how the notice information related to the driving of the vehicle may be displayed through the head lamp for a vehicle in accordance with the embodiment of the present disclosure.

For example, when the vehicle makes a turn, the flip disks 320 of the flip-dot units 300 may be operated to generate a flow in which the flip disks 320 are sequentially rotated along an arrow E, as illustrated in FIG. 10, thereby informing an oncoming vehicle or pedestrian of the vehicle's turn.

In the head lamp for a vehicle in accordance with the embodiment of the present disclosure, the flip-dot unit may be installed in the lamp housing to prevent overheat and moisture in the lamp housing, and effectively transfer the notice information on the state of the vehicle or the notice information related to the driving of the vehicle to an oncoming vehicle or pedestrian.

Although exemplary embodiments of the disclosure have been disclosed for illustrative purposes, those skilled in the art will appreciate that various modifications, additions and substitutions are possible, without departing from the scope and spirit of the disclosure as defined in the accompanying claims. Thus, the true technical scope of the disclosure should be defined by the following claims.

What is claimed is:

1. A head lamp for a vehicle, comprising:
- a lamp housing;
- a light source disposed in the lamp housing and configured to emit light to a forward area of a vehicle;
- a bezel disposed on the lamp housing, spaced apart from the light source, and shaped to cover the light source;
- a plurality of flip-dot units disposed in the bezel, wherein each flip-dot unit among the plurality of flip-dot units comprises:
  - a housing having an opening formed on one side of the housing, and a space formed in the housing; and
  - a flip disk rotatably installed in the housing and configured to selectively open and close the opening;
- a sensor unit disposed in the bezel and configured to measure an internal temperature and internal humidity of the lamp housing; and
- a control unit configured to transmit a flip disk operation signal to each flip-dot unit to rotate the flip disk.

2. The head lamp of claim 1, wherein the housing comprises:
- a first side portion having a plate shape, and having an air flow hole in communication with the opening;
- a second side portion bent and extended from the first side portion, and configured to form the space with the first side portion; and
- a third side portion bent and extended from the second side portion, disposed to face the first side portion, and having the flip disk installed thereon.

3. The head lamp of claim 2, wherein the flip disk is configured to rotate about a rotation axis passing through a center of the third side portion.

4. The head lamp of claim 3, wherein the flip disk has a symmetrical shape with respect to a center axis.

5. The head lamp of claim 1, wherein the control unit is further configured to transmit the flip disk operation signal to each flip-dot unit to rotate and invert the flip disk according to the internal temperature of the lamp housing, as measured by the sensor unit.

6. The head lamp of claim 1, wherein the control unit is further configured to transmit the flip disk operation signal to each flip-dot unit to repeatedly rotate the flip disk according to the internal humidity of the lamp housing, as measured by the sensor unit.

7. The head lamp of claim 1, wherein the control unit is further configured to transmit the flip disk operation signal to each flip-dot unit to display a character or sign for warning an oncoming vehicle or pedestrian.

8. The head lamp of claim 1, wherein the control unit is further configured to control the flip disk to rotate such that a heated surface of the flip disk faces the bezel, in response to the internal temperature of the lamp housing being determined to be equal to or greater than a preset value.

9. The head lamp of claim 1, wherein the control unit is further configured to control the flip disk to repeatedly rotate such that moisture is removed from the lamp housing, in response to the internal humidity of the lamp housing being determined to be equal to or greater than a preset value.

10. A head lamp for a vehicle, comprising:
- a lamp housing;
- a light source disposed in the lamp housing and configured to emit light to a forward area of a vehicle;
- a bezel disposed on the lamp housing, spaced apart from the light source, and shaped to cover the light source;

a plurality of flip-dot units disposed in the bezel, wherein each flip-dot unit among the plurality of flip-dot units comprises:

a housing having an opening formed on one side of the housing, and a space formed in the housing; and a flip disk rotatably installed in the housing and configured to selectively open and close the opening; and a control unit configured to control the flip disk to rotate such that a heated surface of the flip disk faces the bezel in response to an internal temperature of the lamp housing being determined to be equal to or greater than a preset value.

11. A head lamp for a vehicle, comprising:

a lamp housing;

a light source disposed in the lamp housing and configured to emit light to a forward area of a vehicle;

a bezel disposed on the lamp housing, spaced apart from the light source, and shaped to cover the light source;

a plurality of flip-dot units disposed in the bezel, wherein each flip-dot unit among the plurality of flip-dot units comprises:

a housing having an opening formed on one side of the housing, and a space formed in the housing; and a flip disk rotatably installed in the housing and configured to selectively open and close the opening; and a control unit configured to control the flip disk to repeatedly rotate such that moisture is removed from the lamp housing in response to an internal humidity of the lamp housing being determined to be equal to or greater than a preset value.

* * * * *